United States Patent [19]

Erni et al.

[11] 4,065,651

[45] Dec. 27, 1977

[54] KEYBOARD SWITCH ASSEMBLY HAVING FLEXIBLE RUNG LADDER CONTACTS

[75] Inventors: Bruno Erni, Bienne; Pierre-André Meister, Ipsach, both of Switzerland

[73] Assignee: Societe Suisse pour l'Industrie Horlogere Management Services S.A., Bienne, Switzerland

[21] Appl. No.: 687,472

[22] Filed: May 18, 1976

[30] Foreign Application Priority Data

May 23, 1975 Switzerland ..... 6639/75

[51] Int. Cl.[2] ..... H01H 13/70

[52] U.S. Cl. ..... 200/5 A; 200/67 DB; 200/159 A; 200/159 B; 200/275

[58] Field of Search ..... 200/5 R, 5 A, 5 E, 5 EA, 200/61.57, 86 R, 159 A, 159 B, 67 D, 67 DA, 67 DB, 275

[56] References Cited

U.S. PATENT DOCUMENTS

| | | | |
|---|---|---|---|
| 2,320,774 | 6/1943 | Flynt | 200/5 EA |
| 2,658,972 | 11/1953 | Brown | 200/67 DB X |
| 3,485,974 | 12/1969 | Wolf et al. | 200/275 X |
| 3,571,540 | 3/1971 | Richards | 200/67 DB |
| 3,600,528 | 8/1971 | Leposavic | 200/5 A |
| 3,812,313 | 5/1974 | Wolf et al. | 200/86 R |
| 3,854,018 | 12/1974 | Reynolds et al. | 200/275 X |
| 3,941,953 | 3/1976 | Misson et al. | 200/67 DB X |
| 3,947,390 | 3/1976 | Johnson | 200/159 B X |

FOREIGN PATENT DOCUMENTS

| | | | |
|---|---|---|---|
| 485,955 | 10/1953 | Italy | 200/67 DB |
| 545,991 | 2/1974 | Switzerland. | |

*Primary Examiner*—James R. Scott

*Attorney, Agent, or Firm*—Griffin, Branigan and Butler

[57] ABSTRACT

A keyboard having a matrix of keys or pushbuttons arranged in a matrix is provided with a plurality of stationary electrical contacts arranged in a similar matrix. Movable contacts operated by the pushbuttons are provided by a plurality of ladder-shaped flexible conductive members. Each ladder-shaped member extends along one row of pushbuttons and has a "rung" of the ladder extending through the space between a pushbutton and its associated stationary contact. The body of the keyboard is provided with grooves for inserting the ladder-shaped members and the spacing between these grooves is such that the rung portions of the member are flexed upwardly against the pushbutton and out of contact with the stationary contact when the pushbutton is in the normal position. Each flexed rung exhibits a bistable characteristic so that as a pushbutton is depressed, a point is reached at which less force is required to further depress the pushbutton. The stationary contact extends upwardly a sufficient distance to prevent the rung from assuming the second stable state. Hence, when the pushbutton is released the rung returns to its normal position and in doing so moves the pushbutton back to its normal position.

5 Claims, 4 Drawing Figures

KEYBOARD SWITCH ASSEMBLY HAVING FLEXIBLE RUNG LADDER CONTACTS

BACKGROUND OF THE INVENTION

The invention relates to a keyboard for introducing data of the digital type or logical instructions into an instrument for processing or utilising such data such as office calculators or pocket calculators, keyboard arrangements for composing telephone numbers or any other pushbutton arrangement providing an instantaneous return and intended to establish electrical contacts which transmit an order or information.

Known keyboards of this type even if they provide satisfactory performance are generally of a relatively complex construction which places them in a high price level, causes them to occupy more volume than is desired and does not favor their utilization for arrangements where miniaturization is desired.

Swiss Pat. No. 545 991 has, however, suggested that in order to avoid such inconvenient features, a network might be employed comprising a single conductive plate in which elastic tongues have been cut out, these tongues forming moving contact organs having a snap action. The contact of a tongue with a conductive base corresponding thereto is established by an associated pushbutton. The proper functioning of this arrangement requires that such tongues be arched by a permanent deformation after they have been cut out and tempered, thereby causing their manufacture to be relatively complex and expensive. The arrangement of this network as a single piece has the disadvantage that in case of the failure of a single contact the entire network is rendered useless and must be replaced.

SUMMARY OF THE INVENTION

The invention comprises a keyboard in which the keys of pushbuttons are arranged in a matrix so as to actuate movable conductive elements in order to establish an electric contact with fixed conductive elements corresponding thereto, each movable conductive element comprising a rung of a conductive elastic foil member in the form of a ladder, cut from a flat foil and arranged according to a row (or column) of the matrix. The rungs are arranged to respond in a snap fashion to pressure externally applied on the pushbutton corresponding thereto so as to be brought into abrupt contact with their corresponding fixed conductors such contact being broken as soon as the pressure on the pushbutton is relaxed and the pushbutton restored to its initial position by the movable conductor. The ladders are introduced longitudinally into slots provided in an insulating support and arranged so as to give lateral support. They are slightly prestressed by transversal arching thereof at the moment of introducing them into the slots giving them by simple elasticity an initial bias enabling the snap action contact.

The design and manufacture are extremely simple due to the fact that when relaxed the ladders are perfectly planar and no permanent arching is initially necessary. Should there be failure of a contact, there is no necessity to replace the entire network but only the defective ladder serving a single row (or column) of the matrix.

BRIEF DESCRIPTION OF THE DRAWINGS

For a better understanding of the description following, reference will be made to the drawings in which.

DESCRIPTION OF THE PREFERRED EMBODIMENT(S)

Figure 1:
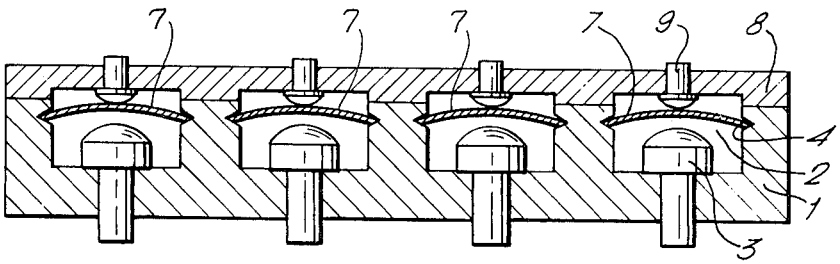
FIG. 1 shows schematically a transversal section of a keyboard according to the invention along the line of a row or column of the matrix.
Figure 2:
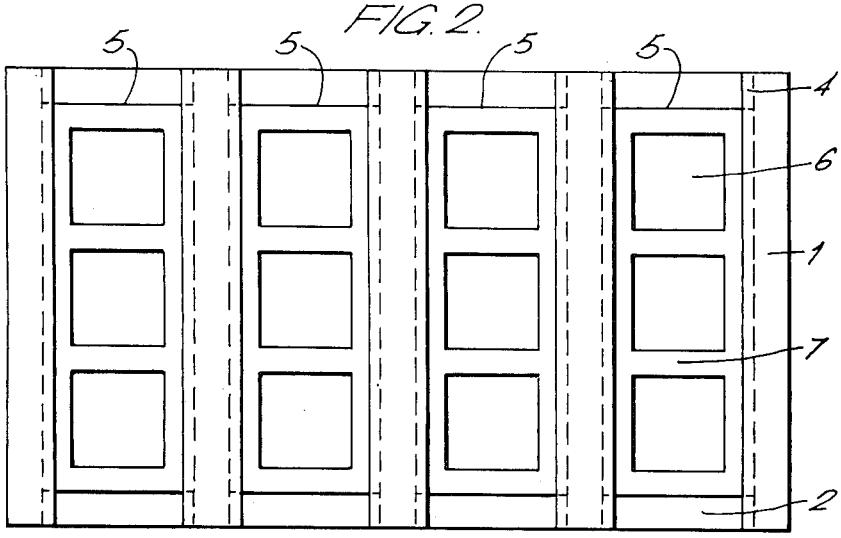
FIG. 2 is a top plan view of the keyboard with the cover removed showing the arrangement of the ladders.

From the cross section as shown in FIG. 1 and the plan view of FIG. 2 it will be seen that the keyboard is formed of a rectangular insulating support member 1 which may to advantage be made from an elastic material in which are arranged a plurality of identical parallel slots 2 having straight rectilinear sides and crossing from one edge support member to the other. At the bottom of each of these slots 2 fixed conductive elements are arranged at regular intervals in a manner so as to form an ordered matrix. These are in the form of studs or rivets 3 which traverse the bottom of the insulating support 1 and of which only the head is presented within the slot 2, the other extremity being coupled in a known manner to a data processing circuit (not shown) printed under the insulating support 1 for example by silk-screen methods.

Figure 3:
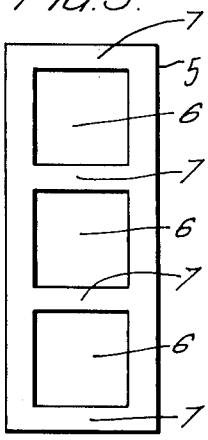
FIG. 3 is a plan view of a ladder in the relaxed position before assembly.

The side walls of slots 2 are each provided at the same height from the bottom with a longitudinal groove 4 of triangular cross section. Each pair of grooves 4 belonging to a slot 2 thus forms a slideway which is intended to receive and to give lateral support to elastic metallic foil 5. Foils 5 may be punched from a planar plate having a length slightly less than that of the slots 2 and a width slightly larger than the distance separating the edges at the bottom of grooves 4 of each slideway. They are put into place in the corresponding slideway by simply pushing them after having elastically flexed them upwardly. This permits their introduction and lateral maintenance without play in the corresponding groove 4 and gives them a bias which permits a snap action. Before the insertion into the slideways 4 rectangular windows 6 are made at regular intervals by punching out foils 5 in a manner so as to form a ladder as shown in FIG. 3 having rungs 7 of small width. The rungs 7 are spaced along each ladder by a distance equal to that which separates the centers of conductive elements 3 at the bottom of slots 2. Rungs 7 comprise the movable conductive elements of the keyboard and, as taught in the aforementioned Swiss Pat. No. 545,991, may be connected to one side of a potential source (not shown).

Figure 4:
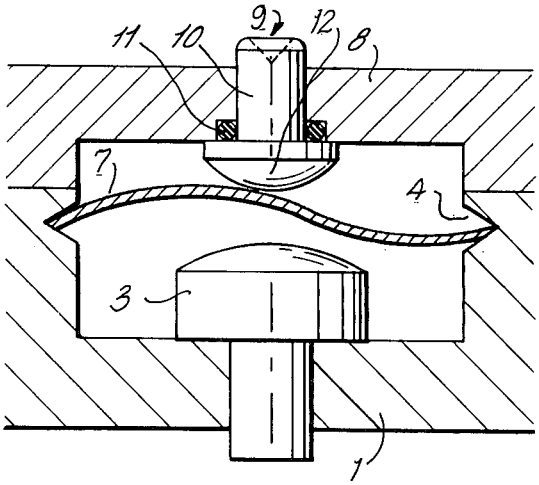
FIG. 4 shows a detail cross section of one of the contact arrangements.

On insulating support 1 is arranged a cover 8 which is likewise insulating and which covers the cavities formed by slots 2 from above. On cover 8 are mounted in a known manner pushbuttons 9 arranged according to a matrix identical to that of the fixed conductive elements 3 carried by support 1. As shown in FIG. 4 these pushbuttons 9 comprise preferably a cylindrical stem 10 transversing with slight play the cover 8 by a passage provided with a conventional O-ring seal 11 and a convex head 12 having a greater diameter than the stem 10 cooperating with the lower wall of cover 8 in order to limit in one direction the axial displacement of pushbuttons 9. These pushbuttons may be depressed in the other axial sense by a pressure exerted from the exterior on the end of their stem or key 10.

The arrangement and the respective dimensions of the fixed conductors 3, the rungs 7 and the pushbuttons 9 are such that at rest rungs 7 maintain through their elasticity the pushbuttons 9 in a non-depressed position. Under the effect of pressure exerted on a pushbutton 9, the corresponding rung 7 springs abruptly into contact with the conductive stud 3 associated therewith by the snap action shown in FIG. 4 and of which the operation is as follows:

With no force applied from the exterior to the key 10 of pushbutton 9 the pressure exerted on such pushbutton by rung 7 maintains it in stable equilibrium. This state is maintained when a pressure is applied on the key up until this pressure exceeds a certain threshold. The rung 7 begins then to be deformed in an asymmetric fashion in a vertical plane and takes a form resembling a reclining "S" greatly flattened (FIG. 4) the pushbutton then being deplaced towards the bottom. If the pressure continues to increase it ends by overcoming the opposing force exerted by the rung 7 and forces the latter to be suddenly deformed in order to arrive at a second position of stable equilibrium imposed by the prestressing and situated on the other side of the plane passing through the base of groove 4. Prior to reaching this second position of stable equilibrium rung 7 is stopped by conductive element 3 with which it comes into abrupt contact, this element having the tendency then to return it towards the initial position of equilibrium. The rung 7 remains however in contact as long as the pressure on pushbutton 9 remains sufficient. If such pressure is relaxed the contact immediately ceases, the rung 7 returns to occupy its initial stable position and brings the pushbutton 9 equally into its rest position.

It will be readily be seen that the ladder construction enables the actuation of each rung 7 or moving conductive element independently of the neighboring rung 7 carried on the same ladder 5. There thus exists no risk of establishing more than the contact which may be sought.

In a known manner each assembly comprising a key 10 or pushbutton 9, rung 7 and conductive stud 3 has associated therewith an item of numeric or alphanumeric data or a logical instruction such as an arithmetic operation.

This data or instruction will be transmitted by the arrangement and transformed into an electrical pulse train which the processing circuit will code and treat in an appropriate manner, this falling outside the scope of the present invention.

To assure a sufficient water resistance of the arrangement a seal may be arranged in a known manner between support 1 and cover 8. It is equally possible to avoid the employment of O-rings 11 equuipping each pushbutton 9 by utilizing a sealing membrane of elastic material covering the entire cover 8 and on which the position of keys 10 could be indicated by any appropriate sign.

The keyboard according to the invention is of extremely simple construction. The ladder form of the movable conductive elements enables a very rapid assembly of the entire arrangement and a failure of a single contact may be corrected by removing and replacing the single ladder corresponding without the necessity of disassembling the entire keyboard.

What we claim is:

1. A keyboard comprising:

a support means;

a cover means;

a plurality of pushbuttons arranged in a matrix of rows and columns and having stem portions extending through said cover means;

a plurality of fixed contact means mounted on said support means in rows and columns whereby a fixed contact means is disposed opposite a corresponding one of said pushbuttons;

a plurality of flexible conductive contact members, one for each row of said matrix, each flexible conductive contact member being in the shape of a flat ladder having rungs, there being a rung for each column of said matrix;

said support means comprising a body having a plurality of partition walls separating a plurality of slots, said slots extending parallel to said rows;

said partition walls having longitudinal grooves therein on each side of each slot to provide a guideway for longitudinally inserting the flexible conductive contact members therein;

each said flexible conductive contact member being planar when unstressed and slightly wider than its guideway so as to require flexing of the rungs to an arched form transverse to the length of the flexible conductive contact member when positioned in said guideway.

2. A keyboard as claimed in claim 1 wherein an access is provided to said slots at an end thereof so that said flexible conductive contact members may be longitudinally inserted therein.

3. A keyboard as claimed in claim 1 wherein each of said arched rungs urges its associated pushbutton to an inactive position, said stem portions of said pushbuttons having enlarged ends which engage said cover means and limit their movement in response to the urgings of said arched rungs.

4. A keyboard as claimed in claim 1 wherein said flexible conductive contact members are supported by said support means in a tensioned state which flexes said rungs in a stable state against their associated pushbuttons, a given rung snapping against its associated fixed contact means when a force is applied to its pushbutton.

5. A keyboard as claimed in claim 4 wherein said fixed contact means extend toward said pushbuttons in the path of said rungs a sufficient distance to prevent a snapping rung from assuming a second stable state, whereby a snapped rung returns to its first stable state as the force on its associated pushbutton is released.

* * * * *